US009234519B2

(12) United States Patent
Dreifert et al.

(10) Patent No.: US 9,234,519 B2
(45) Date of Patent: Jan. 12, 2016

(54) VACUUM PUMP

(75) Inventors: Thomas Dreifert, Kerpen (DE); Wolfgang Giebmanns, Erftstadt (DE); Robert Jenkins, Sussex (GB); Roland Müller, Köln (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 672 days.

(21) Appl. No.: 13/376,691

(22) PCT Filed: Jun. 7, 2010

(86) PCT No.: PCT/EP2010/057899
§ 371 (c)(1),
(2), (4) Date: Dec. 7, 2011

(87) PCT Pub. No.: WO2010/142631
PCT Pub. Date: Dec. 16, 2010

(65) Prior Publication Data

US 2012/0315165 A1 Dec. 13, 2012

(30) Foreign Application Priority Data

Jun. 9, 2009 (DE) ..... 10 2009 024 336

(51) Int. Cl.
*F04C 29/00* (2006.01)
*F04C 29/04* (2006.01)
*F04C 18/16* (2006.01)

(52) U.S. Cl.
CPC ..... *F04C 29/047* (2013.01); *F04C 18/16* (2013.01); *F04C 2220/10* (2013.01); *F04C 2240/30* (2013.01); *F04C 2240/808* (2013.01)

(58) Field of Classification Search
CPC ..... F04C 29/047; F04C 29/04; F04C 29/042; F04C 18/16; F04C 2220/10; F04C 2240/30; F04B 39/06; F04B 39/064; F04B 39/066; F04B 39/12; F04B 39/121; F04B 53/16; F04B 53/08
USPC ..... 417/410.4; 361/695, 696
See application file for complete search history.

(56) References Cited

U.S. PATENT DOCUMENTS

2001/0024617 A1* 9/2001 Ishigure et al. ..... 417/372
2005/0031468 A1 2/2005 Kawaguchi et al.

(Continued)

FOREIGN PATENT DOCUMENTS

CN 1514133 A 7/2004
CN 2624513 Y 7/2004

(Continued)

OTHER PUBLICATIONS

International Search Report for PCT/EP2010/057899 dated Jun. 8, 2011.

(Continued)

*Primary Examiner* — Nathan J Newhouse
*Assistant Examiner* — Philip Stimpert
(74) *Attorney, Agent, or Firm* — Ohlandt, Greeley, Ruggiero & Perle, LLP

(57) ABSTRACT

A vacuum pump comprises pumping elements arranged in a pumping chamber. An electric motor drives the pumping element. A frequency inverter is provided for changing the rotational speed of the electric motor. The frequency inverter is arranged in a frequency inverter housing immediately connected to the pump housing. An air cooler and a liquid cooler are arranged in the frequency inverter housing to cool the frequency inverter.

14 Claims, 1 Drawing Sheet

(56) References Cited

U.S. PATENT DOCUMENTS

| | | | | |
|---|---|---|---|---|
| 2006/0081185 | A1* | 4/2006 | Mauck et al. | 118/723 I |
| 2006/0227504 | A1* | 10/2006 | Chen et al. | 361/687 |
| 2008/0145214 | A1 | 6/2008 | Metzger | |

FOREIGN PATENT DOCUMENTS

| | | | |
|---|---|---|---|
| DE | 19749572 | A1 | 5/1999 |
| DE | 10156179 | A1 | 5/2003 |
| DE | 202008000736 | U1 | 3/2008 |
| DE | 102007048510 | A1 | 4/2009 |
| EP | 0836008 | A | 4/1998 |
| EP | 1936198 | | 6/2008 |
| JP | 2001271777 | A | 10/2001 |
| JP | 2005030227 | A | 2/2005 |
| JP | 2007315269 | A | 12/2007 |
| TW | 200637470 | A | 10/2001 |
| WO | 02/46617 | A1 | 6/2002 |
| WO | 2007026047 | | 3/2007 |
| WO | 2008062598 | A1 | 5/2008 |

OTHER PUBLICATIONS

Written Opinion of the International Search Authority in corresponding International Application No. PCT/EP2010/057899 dated Sep. 12, 2011.

International Preliminary Report on Patentability of the International Search Authority in corresponding International Application No. PCT/EP2010/057899 dated Dec. 12, 2011.

European Office Action dated Apr. 23, 2015 for European application No. 10723116.9.

Taiwanese Examination Report (with English translation) dated Mar. 24, 2015 for Taiwan application No. 099117561.

Chinese Office Action (with English translation) dated Dec. 3, 2013 for Chinese application No. 201080023678.1.

* cited by examiner

VACUUM PUMP

BACKGROUND

1. Field of the Disclosure

The disclosure refers to a vacuum pump, in particular a screw-type vacuum pump, a Roots vacuum pump or a rotary vane vacuum pump.

2. Discussion of the Background Art

Vacuum pumps comprise pumping elements arranged in a pumping chamber formed by the pump housing and serving to convey a fluid, especially a gas such as air. The pumping elements are usually driven by an electric motor. For a simple variation of the rotational speed of the vacuum pump it is known to use frequency inverters, so as to be able to change the motor speed in a simple manner. A frequency inverter is a sensitive electronic component. To allow a good cooling and a vibration-free arrangement of the frequency inverters, it is known to provide them in a control cabinet independent from the vacuum pump and separately from the pump. However, this is troublesome in particular because of the necessary wiring between the control cabinet and the electric motor of the vacuum pump. Therefore, it is generally preferred to arrange the frequency inverter directly at the vacuum pump.

For frequency inverters arranged immediately at the vacuum pump it is known to provide air cooling for the cooling of the frequency inverters. In this case, the cooling is effected using ambient air drawn by a blower and blown towards the frequency inverter. Thus, the cooling is achieved by forced convection. However, such air-cooling means are disadvantageous in that high protection ratings cannot be achieved or only with great effort. Even for lower protection ratings a complex housing is required. Especially in a dirty environment the maintenance effort is high, since frequent cleaning and filter changes are necessary. It is further known to cool the frequency inverters using natural convection, in which case the housing is immediately provided with cooling ribs. However, this design is only possible if the ambient temperatures are correspondingly low and the pump is operated in a performance range where the frequency inverter is not heated up much. Since a free inflow of air has to be guaranteed, a high risk of contamination exists for this design as well.

It is further known to provide the frequency inverter with immediate water cooling. In this case, the frequency inverter is connected with a cooled surface of the vacuum pump. However, this has a drawback that the frequency inverter is exposed to the vibrations of the vacuum pump.

Moreover, the cooling requirements of the vacuum pump and the cooling requirements of the frequency inverter have to correspond to each other.

The frequency inverter used thus has to be adapted to the corresponding requirements. It is further known to provide a separate cooling plate for the frequency inverter, which is connected to a separate cooling circuit.

This is an extremely complex solution. It is a general drawback of water cooling for a frequency inverter that at a high air humidity condensate can also form within the frequency inverter.

It is an object of the disclosure to provide a vacuum pump with a frequency inverter, wherein a reliable cooling of the frequency inverter is guaranteed.

disclosure

SUMMARY OF THE INVENTION

In the vacuum pump of the present disclosure, the at least one pumping element arranged in the pumping chamber is driven by an electric motor. The electric motor is connected to a frequency inverter to allow the motor speed to be changed. The frequency inverter is arranged in a frequency inverter housing—hereinbelow referred to as the FI housing—that is connected directly to the pump housing. According to the disclosure, the FI housing accommodates both an air cooler and a liquid cooler for cooling the frequency inverter. The combination of an air cooler and a liquid cooler, as provided by the disclosure, allows guaranteeing a reliable cooling of frequency inverter even at high thermal stress on the frequency inverter, while at the same time the occurrence of condensate is avoided.

Preferably, the FI housing and the pump housing are formed integrally, it being possible, of course, that both housings consist of several parts. In this context, it is preferred that the FI housing is connected immediately to the pump housing and that a compact structure can thus be obtained.

The air cooler preferably comprises a blower generating a cooling air flow in the FI housing. According to the disclosure, the air flow is cooled by the liquid cooler. This is advantageous in that the frequency inverter is not directly connected to a cooling plate or the like, but the cooling of the frequency inverter is effected by means of an air flow cooled by the liquid cooler. Thereby, the risk of an occurrence of condensate, especially within the frequency inverter, is significantly reduced.

The FI housing may be closed so that the air is circulated. No ambient air has to be drawn in that might be contaminated.

Preferably, the liquid cooler comprises a cooling element arranged in or at the FI housing. The air flows along the cooling element that preferably has cooling ribs to increase the surface. The cooling ribs or the surface of the cooling element along which the air flows is preferably directed towards the frequency inverter. In a preferred embodiment, the liquid cooler comprises a cooling plate in which at least one cooling coil is arranged. The corresponding cooling plate may form a part of the FI housing.

In a particularly preferred embodiment of the disclosure, the liquid cooler is integrated into the coolant circuit of the vacuum pump. Thus, only one coolant circuit is provided. This facilitates the connection of the vacuum pump to a coolant circuit, since no additional coolant circuit has to be connected for the cooling of the frequency inverter.

In another preferred embodiment, the electric motor is also arranged in the FI housing. In this embodiment, the liquid cooler preferably surrounds the electric motor at least partly. Thus, the liquid cooler serves to cool the electric motor and to cool the air flow that cools the frequency inverter. In particular, the liquid cooler of this embodiment surrounds the electric motor completely in the manner of a cooling coil.

Preferably, the FI housing is thermally coupled to the liquid cooler of the electric motor or to a corresponding liquid-cooled housing o the electric motor. Thus, good heat dissipation can be guaranteed.

Since, according to the disclosure, the frequency inverter is cooled by an air flow, it is not necessary to connect the frequency inverter directly to a cooling plate. As provided by the disclosure, this has the advantage that the frequency inverter can be supported by vibration damping elements.

The occurrence of vibration damage to the frequency inverters can further be prevented better by the use of vibration resistant electronics, as well as by glueing or encapsulating the components. Further, a vibration-decoupled component could be used as the mounting site.

It is an essential advantage of the disclosure that the occurrence of condensation damages to the electronics of the frequency inverter is avoided, since the frequency inverter is not coupled directly to the water circuit. The condensation occurring at the coldest component thus takes place at the air cooler or the liquid cooler, but not at the frequency inverter itself, since the same generates waste heat when in operation. Also when the pump is turned off, condensation is avoided, since the frequency inverter is not cooled. To this effect, the blower of the air cooler is preferably operationally coupled to the frequency inverter. Preferably, a condensate drain is provided in the FI housing.

Since the frequency inverter is the component most sensitive to temperature, it is preferred, in a common cooling circuit, to use the coolant first to cool the frequency inverter, thereafter to cool the electric motor and then to cool the pump. Besides, an additional control of the water cooling may be effected.

The integration of the frequency inverters in the pump housing or the FI housing, as provided by the disclosure, has the advantage over the arrangement of the frequency inverters in control cabinets that a small volume of air has to be conveyed. In particular, it is possible to achieve a very well directed guiding of air within the FI housing.

Because of the arrangement of the frequency inverter, as provided by the disclosure, including the cooling realized according to the disclosure, a high protection rating of IP54 can be achieved, for instance.

BRIEF DESCRIPTION OF THE DRAWINGS

The disclosure is set forth in greater detail in the following description with reference to preferred embodiments, including reference to the accompanying drawing in which.

DETAILED DESCRIPTION OF THE PREFERRED EMBODIMENT

Figure 1:
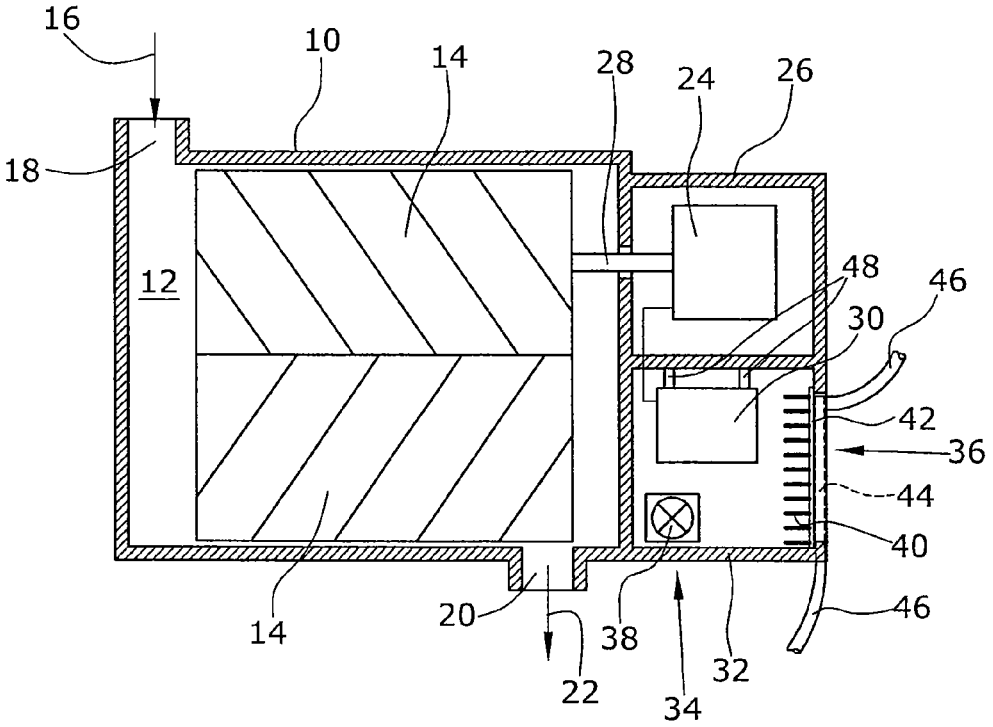
FIG. 1 illustrates a schematic section through a first preferred embodiment of the disclosure.

The Figures each very schematically illustrate screw-type vacuum pumps as examples. Here, a housing 10 defines a pumping chamber 12 in which two pumping screws 14 are arranged as pumping elements which rotate in opposite directions. Usually, this is effected via a transmission not illustrated in the sketches and arranged between the two screw rotors 14. The rotation of the two pumping elements causes an intake of a medium in the direction of an arrow 16 through an inlet opening 18 and an ejection of the medium though an outlet opening 20 in the direction of an arrow 22.

According to the first preferred embodiment of the disclosure, illustrated in FIG. 1, an electric motor 24 is arranged in a portion 26 of the housing. The electric motor 24 is connected to one of the pumping screws 14 via its output shaft 28.

For a control of the rotational speed of the electric motor 24, a frequency inverter 30 is provided that is electrically coupled to the electric motor 24. The frequency inverter 30 is arranged in a frequency inverter housing 32 (FI housing). The FI housing 32 is connected directly to the pump housing 10 or is formed integrally therewith.

An air cooler 34 and a liquid cooler 36 are provided to cool the frequency inverter. In the embodiment illustrated, the air cooler 34 comprises a blower 38. The blower 38 is arranged within the FI housing 32 and serves to circulate the air within the FI housing. Here, the air flow generated by the blower 38 is directed such that it flows along the liquid cooler 36. In the embodiment illustrated, the air flows along cooling ribs 40 of the liquid cooler 36. The cooling ribs 40 are directed towards the interior of the FI housing 32 or towards the frequency inverter 30.

The liquid cooler comprises a cooling element such as a cooling plate 42, which, in the embodiment illustrated, at the same time forms a side wall of the FI housing 32. On the inner side, the cooling ribs 40 are connected to the cooling pate 42. A cooling coil 44 is provided within the cooling plate 40, especially in a meander-like shape. The cooling coil 44 is connected to coolant lines 46. In FIG. 1, these are illustrated as stubs for the sake of clarity. In a preferred embodiment, the coolant lines 46 are connected both to the liquid cooling system of the electric motor 24 and of the vacuum pump itself. Here, the coolant lines 46 preferably extend within the housing or immediately along the housing outer walls.

The frequency inverter 30 is supported at one of the housing walls of the FI housing 32 by means of vibration dampers 48.

Figure 2:
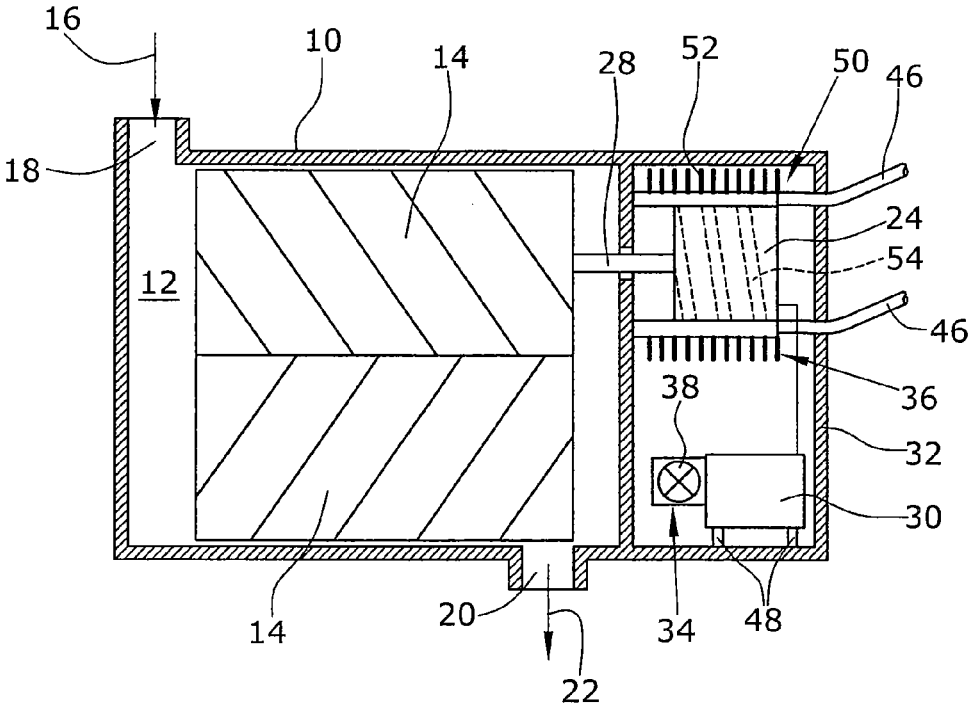
FIG. 2 illustrates a schematic section through a second preferred embodiment of the disclosure.

In the second preferred embodiment (FIG. 2) identical or similar components are identified by the same reference numerals. The essential difference from the first embodiment (FIG. 1) is that the electric motor 24 is arranged within the FI housing 32. A separate cooling element provided to form the liquid cooler for the frequency inverter 30 can thus be omitted. The motor 24 is surrounded by a liquid cooler 50. The same preferably encloses the motor 24 entirely and has outwardly directed cooling ribs 52. Arranged within the liquid cooler 50 is a helically arranged cooling coil 54 surrounding the electric motor 24. This coil is again connected to the coolant lines 46.

Corresponding to the first embodiment (FIG. 1), a blower 38 is arranged in the FI housing 32. The same circulates the air in the FI housing 32, the air being guided such that it flows along the ribs 52 for cooling.

Although the disclosure has been described and illustrated with reference to specific illustrative embodiments thereof, it is not intended that the disclosure be limited to those illustrative embodiments. Those skilled in the art will recognize that variations and modifications can be made without departing from the true scope of the disclosure as defined by the claims that follow. It is therefore intended to include within the disclosure all such variations and modifications as fall within the scope of the appended claims and equivalents thereof.

The invention claimed is:

1. A vacuum pump comprising:

a pump housing forming a pumping chamber, at least one pumping element arranged in the pumping chamber, an electric motor for driving the at least one pumping element, a frequency inverter for changing the rotational speed of the motor, connected to the electric motor, an air cooler, and a motor liquid cooler having outwardly directed cooling ribs, wherein the frequency inverter is arranged in a frequency inverter housing immediately connected to the pump housing, wherein the electric motor is arranged within the frequency inverter housing, wherein the motor liquid cooler at least partly surrounds the electric motor to directly cool the motor, and wherein the air cooler and the motor liquid cooler are arranged in the frequency inverter housing so that the motor liquid cooler cools an air flow from the air cooler guided to flow along the cooling ribs to indirectly cool the frequency inverter.

2. The vacuum pump of claim 1, wherein the frequency inverter housing and the pump housing are formed integrally.

3. The vacuum pump of claim 1, wherein the air cooler comprises a blower generating the air flow cooling the frequency inverter.

4. The vacuum pump of claim 1, wherein the cooling ribs increase the surface, which ribs are directed towards the frequency inverter.

5. The vacuum pump of claim 4, wherein the motor liquid cooler comprises a cooling coil through which a coolant flows.

6. The vacuum pump of claim 5, wherein the cooling coil is arranged in the motor liquid cooler, in a helical manner, surrounding the electric motor.

7. The vacuum pump of claim 1, wherein the frequency inverter and/or the frequency inverter housing is/are supported by vibration damping elements.

8. The vacuum pump of claim 1, wherein the frequency inverter housing is connected in a thermally coupled manner to a liquid-cooled housing of the electric motor.

9. The vacuum pump of claim 1, wherein the frequency inverter housing is closed so that the air flow is circulated without drawing in ambient air.

10. A vacuum pump comprising:

a pump housing forming a pumping chamber;

a frequency inverter housing thermally connected to the pump housing;

a pumping element in the pumping chamber;

an electric motor in the frequency inverter housing and operatively connected to the pumping element;

a frequency inverter operatively connected to the electric motor;

a motor liquid cooler in the frequency inverter housing to directly cool the motor;

an air cooler in the frequency inverter housing that generates an air flow in the frequency inverter housing that is cooled by the motor liquid cooler so as to cool the frequency inverter with the cooled air flow, wherein the frequency inverter housing is closed so that the air flow is circulated without drawing in ambient air.

11. The vacuum pump of claim 10, wherein the motor liquid cooler at least partly surrounds the electric motor.

12. The vacuum pump of claim 10, wherein the frequency inverter housing and the pump housing are formed integrally.

13. The vacuum pump of claim 10, wherein the motor liquid cooler comprises a cooling coil through which a coolant flows.

14. The vacuum pump of claim 10, wherein the frequency inverter is supported in the frequency inverter housing by vibration damping elements.

* * * * *